US008234969B2

(12) United States Patent
Beckmann

(10) Patent No.: US 8,234,969 B2
(45) Date of Patent: Aug. 7, 2012

(54) ELECTRONIC TRIGGER APPARATUS FOR USE WITH FIREARMS

(75) Inventor: Rudi Beckmann, Aichhalden (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 431 days.

(21) Appl. No.: 12/511,663

(22) Filed: Jul. 29, 2009

(65) Prior Publication Data

US 2010/0186277 A1 Jul. 29, 2010

Related U.S. Application Data

(63) Continuation-in-part of application No. PCT/EP2008/000730, filed on Jan. 30, 2008.

(30) Foreign Application Priority Data

Jan. 30, 2007 (DE) ..... 10 2007 004 587

(51) Int. Cl.
*F41A 19/16* (2006.01)

(52) U.S. Cl. ..... 89/136; 89/132; 42/84; 42/69.01

(58) Field of Classification Search ..... 89/135, 89/132, 136, 28.05, 28.1; 42/84, 106, 69.01
See application file for complete search history.

(56) References Cited

U.S. PATENT DOCUMENTS 2,871,604 A * 2/1959 Norman ..... 42/69.01
3,703,845 A * 11/1972 Griew ..... 89/134
4,275,521 A * 6/1981 Gerstenberger et al. ..... 42/84
4,510,844 A * 4/1985 Fritz et al. ..... 89/135
4,754,567 A * 7/1988 Lehfeldt et al. ..... 42/69.02
5,083,392 A 1/1992 Bookstaber
5,713,150 A * 2/1998 Ealovega ..... 42/84
5,901,488 A 5/1999 Oberlin
6,131,324 A * 10/2000 Jewell ..... 42/69.03
6,347,474 B1 * 2/2002 Wolff, Jr. ..... 42/69.01

(Continued)

FOREIGN PATENT DOCUMENTS

DE 1216155 5/1966

(Continued)

OTHER PUBLICATIONS

International Searching Authority, "Written Opinion of the International Searching Authority," issued in connection with PCT/EP2008/000730, 10 pages.

(Continued)

*Primary Examiner* — Benjamin P Lee
(74) *Attorney, Agent, or Firm* — Hanley, Flight & Zimmerman, LLC

(57) ABSTRACT

Electronic trigger apparatus for use with firearms are described herein. An example electronic trigger apparatus described herein includes a trigger assembly having a trigger and trigger arm that is movable between a first position and a second position. A first biasing element biases the trigger in the first position and provides a first resistance to the trigger when the trigger moves between the first position and the second position. A switch element assembly has a spring element and a sensor operatively coupled to the spring element where the spring element provides a second resistance to the trigger as the trigger moves between a pressure-point position and the second position. The sensor detects a force or deflection imparted on the spring element by the trigger arm when the trigger is in the second position.

20 Claims, 3 Drawing Sheets

U.S. PATENT DOCUMENTS

| | | | | |
|---|---|---|---|---|
| 6,604,311 | B1 * | 8/2003 | Laney et al. | 42/51 |
| 6,651,542 | B2 * | 11/2003 | Danner et al. | 89/28.05 |
| 7,131,366 | B2 | 11/2006 | Danner et al. | |
| 2002/0078615 | A1 * | 6/2002 | Danner et al. | 42/69.01 |
| 2009/0188145 | A1 * | 7/2009 | Fluhr et al. | 42/69.01 |

FOREIGN PATENT DOCUMENTS

| | | |
|---|---|---|
| DE | 3147886 | 6/1983 |
| EP | 0276843 | 8/1988 |
| FR | 2788124 | 7/2000 |

OTHER PUBLICATIONS

International Searching Authority, "International Search Report," issued in connection with PCT/EP2008/000730, mailed May 6, 2008, 4 pages.

International Bureau, "International Preliminary Report on Patentability," issued in connection with international application No. PCT/EP2008/000730, issued Aug. 4, 2009, 7 pages.

* cited by examiner

ELECTRONIC TRIGGER APPARATUS FOR USE WITH FIREARMS

CROSS-REFERENCE TO RELATED APPLICATIONS

This patent is a continuation-in-part of International Patent Application Serial No. PCT/EP2008/000730, filed Jan. 30, 2008, which claims priority to German Patent Application 10 2007 004 587.7, filed on Jan. 30, 2007, both of which are hereby incorporated herein by reference in their entireties.

FIELD OF THE DISCLOSURE

The present disclosure relates generally to electronic trigger apparatus and, more particularly, to electronic trigger apparatus for use with firearms.

BACKGROUND

Firearms or weapons may be employed with different trigger apparatus or devices that provide different trigger pull resistances to discharge the firearm. The amount of trigger pull resistance provided by a trigger apparatus may affect the precision of a shot. For example, it is sufficient for a flare gun to typically employ a trigger apparatus providing between 25 Newton (N) and 50 N of trigger force or pull resistance to discharge the flare gun because a flare gun is not used to accurately shoot an intended target with precision. In contrast, a military rifle may be implemented with a trigger apparatus that provides less than 45 N of trigger force or pull resistance to discharge the rifle. Additionally, the user should be able to determine the discharge position of the trigger apparatus based on the resistance. A target gun, a precision rifle, and/or a hunting weapon typically employ a trigger apparatus that provides less than 15 N of trigger force or pull resistance to discharge the weapon. In some examples, firearms include adjustable mechanisms to adjust the amount of trigger pull resistance or force required to discharge the firearm.

Moreover, the trigger pull resistance or force to be overcome by a user to discharge the firearm may be dependent on the mechanical structure of the trigger apparatus and/or the tolerances required for manufacturing. For self-loading firearms (e.g., a pistol), a trigger apparatus must also be configured to tolerate vibrations experienced by the firearm during recoil. For example, a trigger catch of the trigger apparatus must be configured to reliably function despite the recoil generated by a previous shot. Thus, mechanically operated trigger apparatus must mechanically move between distinct positions to properly reset or reload between each shot that is discharged. As a result, for self-loading, semi-automatic firearms, for example, a user is interrupted between shots. In other words, a user must release the trigger to a predetermined position while, for example, the trigger engages a sear arm arrangement, a chamber is loaded with a new cartridge, a catch engages and retains the firing pin in a cocked position, etc. Such interruption may provide a duration that is long enough to interrupt or affect the precision of the user or shooter (i.e., a shooter may have to realign the firearm to an intended target).

Electronically-operated trigger apparatus, on the other hand, typically employ a contact to discharge the firearm. In contrast to a mechanically operated trigger apparatus, electronic trigger apparatus typically lack a linkage mechanism to activate a firing pin, which strikes the cartridge to discharge the firearm. Instead, the electronic trigger apparatus engages a contact or switch that generates a signal to discharge the firearm. Compared to mechanically operated trigger apparatus, such configuration significantly reduces the duration between consecutive discharges when employed with self-loading semi-automatic firearms.

However, a trigger pull of an electronic trigger apparatus is substantially less than the trigger pull of a mechanical trigger apparatus. For example, non-self loading target firearms implemented with an electrical trigger apparatus may typically require 0.04 N of force to overcome pull resistance to discharge the firearm, as compared with to an amount of 0.4 N of force or pull resistance to discharge the same firearm employed with a mechanical trigger apparatus. Nonetheless, in both cases, because the trigger force is so small, a user placing the firearm down on a surface may be sufficient to discharge the firearm. Additionally, due to lack of physical space in the firearm (e.g., a hand-held pistol), electronically activated trigger apparatus typically provide a simple or light trigger release. Such a configuration is drastically different than a firearm having a trigger apparatus that must overcome a pressure point or trigger slack region (e.g., double-stage) to discharge the firearm. Additionally, for safety purposes, a trigger apparatus should typically employ a trigger that provides more than 10 N of force or trigger pull resistance to discharge the firearm. Thus, electronic trigger apparatus are typically configured as single-pull or single-stage triggers.

Sport rifles and/or firearms, such as those used in the biathlon or the Olympics, are typically desired to have a trigger apparatus that has a trigger slack region (e.g., a two-stage trigger). In this manner, a sharpshooter may engage the trigger without discharging the firearm when aiming the firearm at an intended target. Trigger slack may prevent discharge of the firearm even if the shooter's hand is shaking due to excitement or exertion, but allows the sharpshooter to fire precise, rapid shots. Rapid shooting is desired with sport rifles because the contestants are timed during the competition, and the contestant to discharge the firearm in the fastest amount of time and hit the intended targets with the most precision wins the competition.

DETAILED DESCRIPTION

Figure 1:
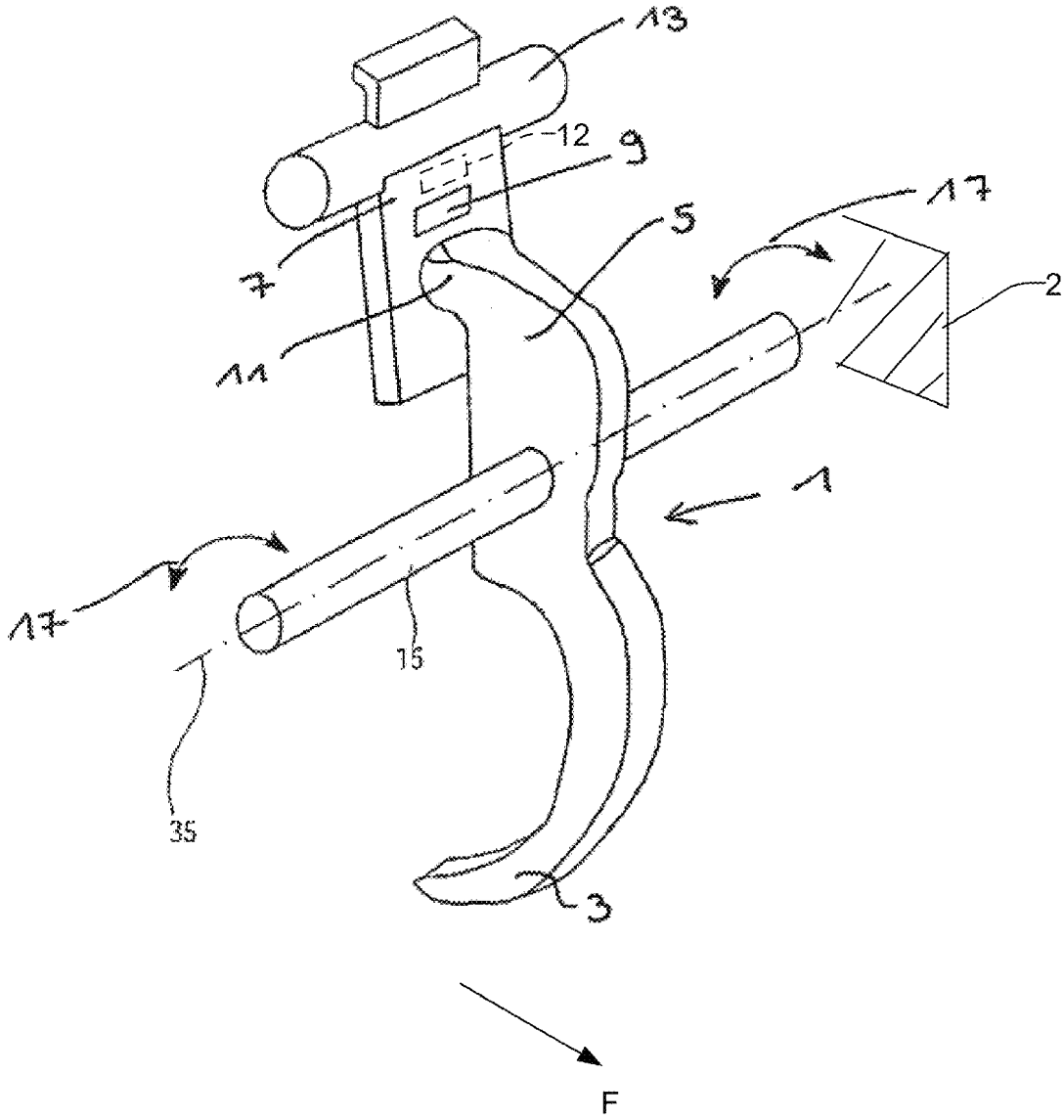
FIG. 1 illustrates an example trigger apparatus described herein.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the firearm is always assumed, i.e., the position in which the barrel runs along a horizontal axis.

A firearm or weapon typically employs a mechanical trigger apparatus or mechanism to fire or discharge the firearm. In general, to discharge a firearm, a user applies a force to move a trigger (e.g., using his index finger) along a trigger path between an initial position and a discharge position. In turn, at the discharge position, the trigger apparatus typically actuates a hammer or a striker that causes the firearm to discharge or fire. Trigger apparatus or mechanisms are typically classified as single-stage or single-pull or two-stage trigger apparatus. The amount of trigger force and the length of travel path of the trigger between the initial position and the discharge position vary with different types of trigger apparatus.

For example, a single-stage trigger apparatus typically requires a user to apply a continuous pressure to the trigger (e.g., a light trigger pull weight) as the trigger moves or travels along a relatively short trigger path to discharge the firearm. Single-stage triggers often provide relatively short travel paths and/or require relatively small amounts of force to discharge the weapon. A reduction in trigger force and/or trigger travel path results in a more rapid discharge which, in turn, may increase the likelihood of a more accurate shot. However, such example single-stage triggers that employ a relatively short travel path and/or a relatively small amount of force to discharge the firearm (e.g., a light trigger pull) may cause unintentional discharge of the firearm. For example, a trigger apparatus that provides a small resistance (e.g., a light trigger) can discharge accidentally if the firearm is dropped.

A two-stage trigger apparatus, on the other hand, includes a second or additional trigger path having a defined resistance. In this manner, after a trigger travels or moves along a first trigger path, a user must typically increase pressure or force to move the trigger through the second trigger path and overcome an increased resistance between a pressure point position and the discharge position (i.e., trigger slack region). Alternatively, the user may release the trigger prior to the discharge position without discharging the firearm. In other examples, the user may hold the trigger approximately in the pressure-point position while aiming at an intended target. Thus, in some examples, a two-stage trigger apparatus may be more advantageous than the single-stage trigger apparatus because the two-stage trigger enables a user to identify the pressure-point position (e.g., prior to the discharge position). However, such additional trigger travel path and the increased resistance may increase the time required to discharge the firearm, thereby affecting the accuracy of a shooter's (e.g., a marksman) intended target.

In contrast to a single-stage trigger, the two-stage trigger provides an additional trigger path having a defined trigger resistance. For example, the first trigger travel path may often allow a user to move the trigger of the firearm between an initial position and a pressure-point position, and back to the initial position without causing the firearm to discharge. Once the first travel path is overcome, a user must typically move the trigger along a trigger slack region or second travel path to discharge the firearm. The trigger slack region provides an abrupt increase in trigger resistance between the pressure-point position and the discharge position. The user can hold the trigger at the trigger slack region until an intended target is in sight, and then increase the tension or force in the trigger finger to pull the trigger through the trigger slack region to discharge the firearm. The second travel path is relatively short and has a different resistance than the first travel path. Thus, the two-stage trigger has two different trigger travel paths that provide different trigger pull forces so that the user (e.g., the shooter) can sense a change in trigger force prior to discharge of the firearm.

Known electronic trigger apparatus typically do not provide an increased trigger pull resistance often provided by two-stage triggers. Such known electronic trigger apparatus usually employ a contact to discharge the firearm. Such contact or small resistance trigger apparatus may be prone to unintended discharges due to, for example, vibrations caused when the firearm is set down or dropped.

The example electronic trigger apparatus described herein provide an electronically activated two-stage trigger. The example trigger apparatus includes an adjustable trigger spring that can be adjusted to provide an increased or decreased trigger pull resistance without causing a substantial increase in the length of the first travel path. In other words, the trigger pull resistance exerted by the trigger during the first travel path may be increased or decreased. Additionally, the trigger apparatus is self-balanced (e.g., via a counterweight) and thus, can be decoupled from a contact (e.g., a discharge contact) to oppose external forces due to, for example, vibrations (e.g., caused by dropping the firearm). Also, in this example, the contact, being decoupled or disengaged from the trigger apparatus, is provided without movable components or the like, thereby reducing wear of the contact and increasing the life of the contact.

Also, the example electronic trigger apparatus employs a contact or a switch element to discharge the firearm. A sensor (e.g., a strain-gauge) is operatively coupled to the contact. A portion of the trigger apparatus engages the contact at the pressure-point position and imparts a force to defect the contact when the trigger apparatus is in the discharge position. The sensor detects the force or deflection imparted to the contact by the trigger apparatus and conveys a signal to, for example, a circuit, a microprocessor, etc. The firearm discharges if the signal provided by the sensor satisfies a predetermined threshold value. In one example, the contact includes a spring member that is deflected by the trigger apparatus to actuate the contact. The spring member has a mass that is small compared to the force required to deflect the spring member. Thus, a relatively larger force or acceleration is required to discharge the firearm compared to a force or vibration imparted on the firearm due to, for example, accidentally dropping the firearm.

FIG. 1 illustrates an example electronic trigger apparatus 1 that may be used with a firearm such as, for example, a rifle, a sharpshooter rifle, etc. The example trigger apparatus 1 is configured as a two-stage trigger that provides a first trigger pull resistance during a first trigger path and a second trigger pull resistance during a second trigger path or trigger slack region. For example, the trigger apparatus provides a first trigger pull resistance between the initial position and a pressure-point position and a second trigger pull resistance between the pressure-point position and the discharge position. The firearm discharges when the trigger apparatus 1 is in the discharge position. In this manner, for example, a user or shooter may move the trigger apparatus 1 between the pressure-point position and the discharge position to discharge the firearm after a first shot has been discharged. In other words, a user may maintain the firearm in alignment with an intended target without having to move the trigger apparatus 1 to the initial position during consecutive shots. In this example, the first trigger pull length and/or the first trigger pull resistance are adjustable.

As illustrated in FIG. 1, the trigger apparatus 1 includes a trigger 3 having a trigger arm 5 pivotally coupled to, for example, a frame or stock 2 of a firearm about an axis 35. As shown, a biasing element 15 depicted as a torsion spring is coupled to the trigger arm 5 about the axis 35. The biasing element 15 biases the trigger apparatus 1 to the initial position and provides or exerts a first path trigger resistance or force. The axis 35 is substantially perpendicular to the center of gravity of the trigger apparatus 1 and the biasing element 15 is coaxial and parallel to the axis 35.

In this manner, the trigger apparatus 1 is substantially balanced about the axis 35. As a result, the trigger apparatus 1 remains balanced when the trigger apparatus 1 is rotated about the axis 35 between the initial position and the discharge position and, thus, may be provided with a double pull trigger having a relatively low or "light" trigger weight and having two stages of resistance. Also, the trigger 3 can be decoupled from other moving or discharge components. As a result, unintentional external forces imparted on the firearm do not influence the position of the trigger apparatus 1 about the axis 35. For example, even if the biasing element 15 is adjusted to provide a relatively light trigger pull resistance, forces imparted on the firearm other than a force imparted on the trigger 3 by a user's index finger will not cause the firearm to discharge. Additionally, although not shown, the trigger 3 may include for example, a counterweight to balance the trigger 3 about the axis 35.

Although not shown, the firearm may include a trigger bar to receive (e.g., slidably receive) the biasing element 15. The trigger bar may be pivotally coupled to the frame or stock 2 of a firearm to enable rotation of the trigger apparatus 1 relative to the frame of the firearm. Additionally or alternatively, although not shown, each ends of the biasing element 15 may be clamped or fixed (e.g., via clamps) to the trigger bar and/or the frame of the firearm. The biasing element 15 can be adjusted at one and/or both ends via the clamps in the direction of arrow 17 shown in FIG. 1. In another example, the biasing element 15 may be pivotally coupled to the frame without the use of a trigger bar. Thus, the amount of resistance exerted by the biasing element 15 may be increased or decreased as indicated by the arrows 17.

The trigger assembly 1 pivots between the initial position and the discharge position. At the initial position, the trigger 3 is not actuated. A portion 6 of the trigger arm 5 engages or rests against a stop (not shown) of the firearm. When the trigger 3 is pulled or pivoted about the axis 35 toward the discharge position (in a counterclockwise direction about the axis 35 in the orientation of FIG. 1), the trigger 3 travels through a first trigger pull path. During the first trigger pull path, the biasing element 15 exerts a force against the trigger 3 to bias the trigger 3 toward the initial position (i.e., in a clockwise direction in the orientation of FIG. 1). When the trigger 3 is pulled along the first trigger path, the trigger arm 5 moves away from or disengages the stop (not shown) of the firearm. A nose or edge 11 of the trigger arm 5 engages a contact or electric switch 7 when the trigger 3 moves through the second travel path that provides a different or increased resistance above the resistance provided by biasing element 15. For example, the edge 11 engages the contact 7 when the trigger 3 moves between the pressure-point position and the discharge position. In some examples, the contact 7 may be a bending element, a torsion element, a lever arm, etc.

In this example, the contact 7 is a spring element (e.g., a leaf spring) disposed adjacent (e.g., substantially vertical relative to) the edge 11 and is clamped or coupled to a spring clamp 13 at a first end. A second end of the contact deflects or moves relative to the first end. In this example, the contact 7 has a mass that is substantially small relative to its spring resistance and/or force properties. In this example, the spring clamp 13 is adjustable by twisting either or both ends of the spring clamp 13 to adjust the amount of trigger slack and/or the travel length of the trigger 3.

In this example, a sensor or sensing element 9 is operatively coupled to the contact 7 to detect a force or deflection imparted on the contact 7 by the trigger arm 5 when the edge 11 engages the contact 7. In this example, the sensor 9 is a strain gauge. However, in other examples, the sensor 9 may include a load cell, a transducer, a force-sensor, a force-sensing resistor, a piezo-electric sensor, etc.

When the contact 7 is deflected or a force is imparted thereon by the edge 11, the sensor 9 generates or conveys an output signal (e.g., a voltage signal). The sensor 9 is operatively coupled to, for example, a circuit or microprocessor (not shown) via wires and/or other electrical components (not shown). To provide a stronger or amplified signal, the contact 7 may include another sensor (e.g., a sensor disposed on the opposite side of the sensor 9). Additionally, although not shown, the firearm may be configured to compensate for a change in temperature based on a signal provide by a thermal sensor.

In operation, the biasing element 15 biases (e.g., loads) the trigger 3 (e.g., in a clockwise direction in the orientation of FIG. 1) about the axis 35 so that the trigger arm 5 engages or rests against the stop (not shown) of the firearm opposite the contact 7. A user, for example using his index finger, applies a force to pull the trigger 3 in the direction indicated by arrow F in FIG. 1 to rotate the trigger 3 about the axis 35 in a counterclockwise direction in the orientation of FIG. 1. If the trigger 3 is depressed or pulled, the trigger 3 disengages or vacates the stop and the edge 11 travels a distance between the initial position and the position in which the edge 11 engages the contact 7. The distance in which the trigger 3 is pulled between the initial position and the position in which the edge 11 engages the contact 7 is the first trigger path in which resistance to trigger pull is provided only by biasing element 15. Thus, when the trigger 3 is actuated (i.e., moved toward the discharge position) or pulled in the first trigger path, the biasing element 15 exerts or provides a first resistance to the trigger 3 during the first trigger path.

When the edge 11 engages the contact 7, the pressure-point position is reached and an increased force is required to deflect or move the contact 7. After the edge 11 engages the contact 7, the trigger 3 must travel through the second travel path, or the trigger slack region, to discharge the firearm. As the trigger 3 travels through the second travel path, the edge 11 engages the contact 7 to deflect the second end of the contact 7. As the edge 11 of the trigger arm 5 engages the contact 7, the resistance exerted on the trigger 3 increases as the trigger arm 5 deflects the contact 7 during the second trigger path. Thus, the force required to move the trigger 3 through the second trigger path is greater than the force required to pull the trigger 3 through the first trigger path.

A deflection of the contact 7 is sensed by the sensor 9. The sensor 9 generates or sends a signal to the circuit (not shown). A comparator may be used to determine if the signal provided by the sensor 9 is greater than a threshold, less than a threshold, and/or between upper and lower threshold limits. When the signal provided by the sensor 9 satisfies a threshold, the signal causes the firearm to discharge (e.g., sensor 9 generates a signal to an electrically activated primer).

The threshold value may be adjustable via, for example, a potentiometer 12. For example, the threshold value can be adjusted to provide a trigger having a relatively small trigger slack (e.g., a small trigger pull resistance) or a relatively large trigger slack (e.g., a large trigger pull resistance). Additionally, the trigger pull resistance is dependent on the resistance provided by the biasing element 15. However, because the trigger assembly 1 is balanced about its center of gravity, the resistance provided by the biasing element 15 can be relatively low. Thus, the example trigger apparatus 1 may be adjusted to provide various trigger forces to accommodate, for example, a sharpshooter, a marksman, a hunter, or other users or shooters. When the trigger 3 is released, the biasing element 15 biases the trigger 3 to the initial position until the trigger arm 5 engages the stop (not shown) of the firearm. Alternatively, after the first shot is discharged, a user may move the trigger 3 between the pressure-point position and the discharge position to fire consecutive shots.

Figure 2:
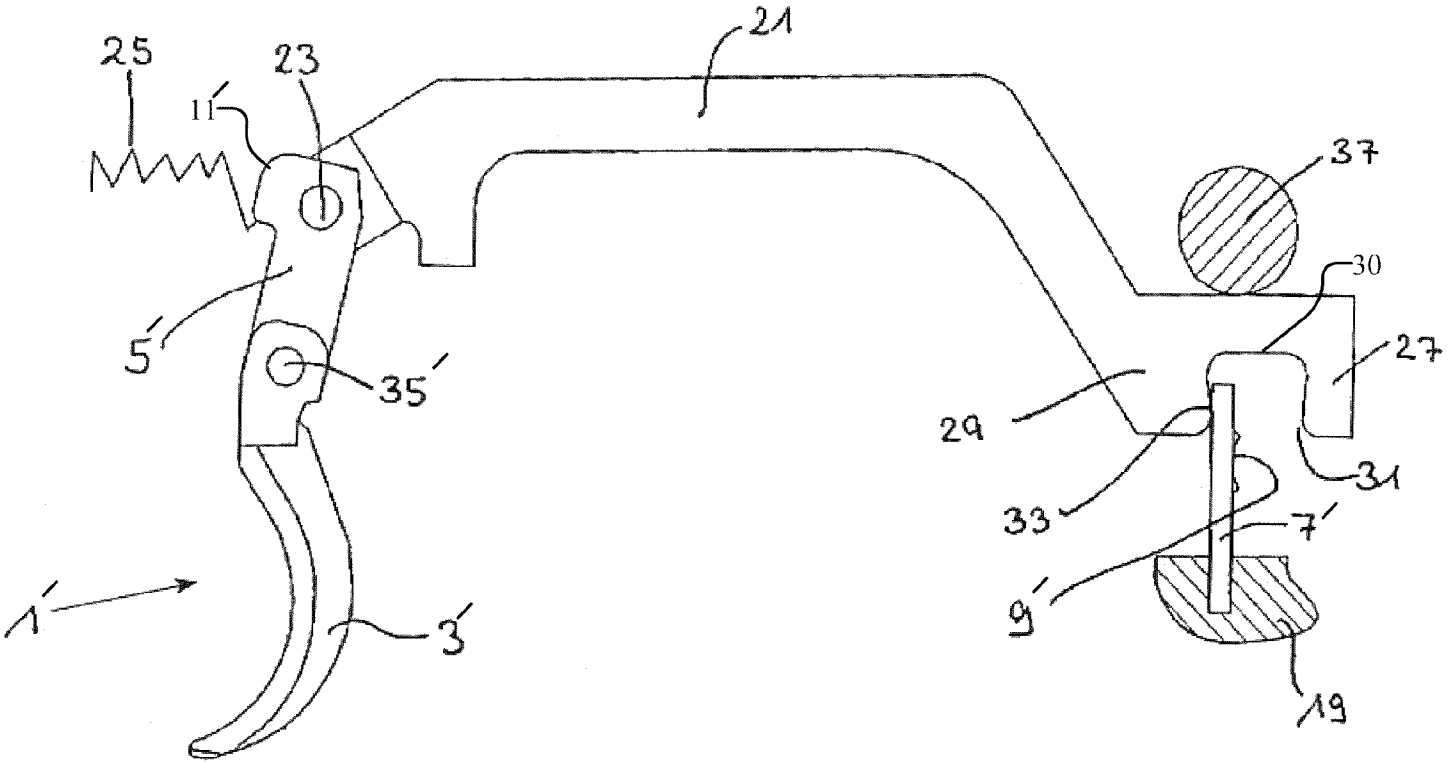
FIG. 2 illustrates another example trigger apparatus described herein shown in a non-discharge position.
Figure 3:
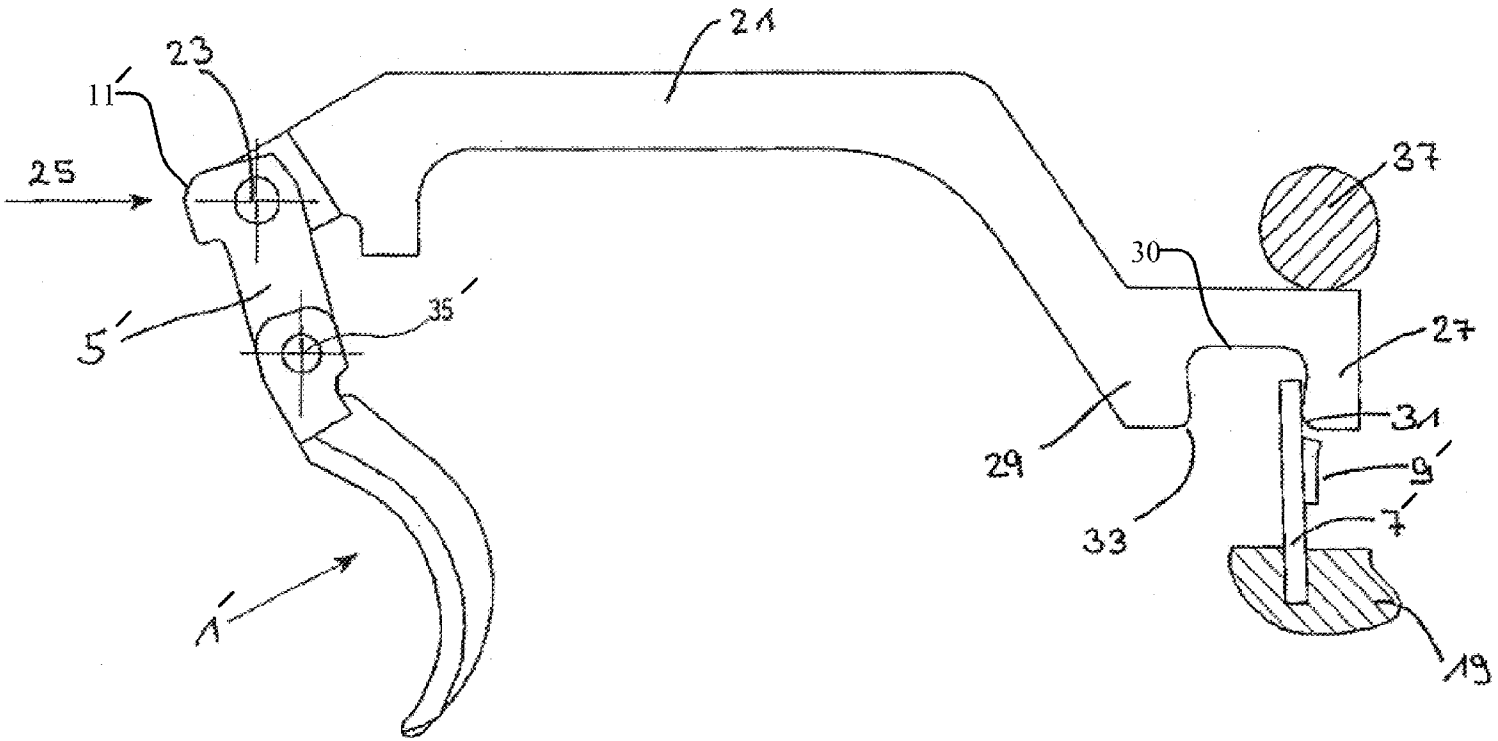
FIG. 3 illustrates the example trigger apparatus of FIG. 2, but shown in a discharge position.

FIGS. 2 and 3 illustrate another example electronic trigger apparatus 1' described herein that may be used with, for example, a self-loading firearm or pistol. FIG. 2 illustrates the trigger apparatus 1' at an initial position and FIG. 3 illustrates the trigger apparatus 1' at a pressure-point position. The example electronic trigger apparatus 1' provides a two-stage trigger pull. For example, the trigger apparatus 1' provides a first trigger pull resistance between the initial position and the pressure-point position and a second trigger pull resistance (i.e., trigger slack region) between the pressure-point position and a discharge position. In this manner, for example, a user or shooter may move the trigger apparatus 1' between the pressure-point position and the discharge position to discharge the firearm after a first shot has been discharged. In other words, a user may maintain the firearm in alignment with an intended target without having to move the trigger apparatus 1' to the initial position during consecutive shots.

Additionally, due to the space limitations of a pistol in a trigger region above and to the front of the firearm, the example electronic trigger apparatus 1' is configured to be disposed to the rear of the trigger region proximate other electronic devices and/or a power source.

The example electronic trigger apparatus 1' includes a trigger 3' and a lever arm 5'. The trigger 3' pivots or rotates about an axis 35' relative to, for example, a frame of a pistol. For example, the trigger 3' may be pivotally coupled to a grip portion of the pistol such that the trigger 3' moves between the initial position (FIG. 2) and the pressure-point position (FIG. 3) about axis 35'. A trigger spring 25 is disposed between a frame portion of the pistol and a surface or edge 11' of the trigger arm 5'. As shown in FIG. 3, the trigger spring 25 is illustratively represented by an arrow (of force). The force required to actuate the trigger 3' (i.e., the "trigger weight") through the first travel path is provided by the trigger spring 25, which may be adjusted. The resistance provided by the trigger spring 25 may be increased or decreased.

A lever or rod 21 operatively couples the trigger 3' to a contact or electric switch 7'. In this example, the contact 7' is depicted as a spring element (e.g., a leaf spring). A first end of the contact 7' is fixed and a second end opposite the first end of the contact 7' can deflect or move relative to the first end. A first portion of the rod 21 is coupled to the trigger arm 5' via, for example, a pivot pin 23. In this manner, rotation of the trigger 3' about the axis 35' causes the rod 21 to move between a first position corresponding to the initial position of the trigger 3' and a second position corresponding to the discharge position of the trigger 3'. Because the rod 21 is coupled to the triggers 3', unwanted external forces (other than the force exerted by a user) may cause the trigger 3' to move, thereby causing the rod 21 to engage the contact 7'. However, the spring 25 counteracts the movement of the rod 21 toward the contact 7'. Also, the weight of the rod 21 may be relatively low such that a light spring may be employed to provide a light trigger (e.g., a trigger slack of approximately 20N). Thus, the example trigger apparatus 1' provides a safety to prevent unwanted discharge of the firearm.

In other examples, the rod 21 may be operatively coupled to the trigger 3' such that the rod 21 can decouple from the trigger 3' when the trigger 3' is in the initial position and engage or couple to the rod 21 when the trigger 3' is in the trigger slack region. In yet another example, the trigger 3' may be coupled to the rod 21 such that the rod 21 biases the trigger 3' to toward the initial position. In other words, such that the weight of the rod 21 exerts a force against the trigger pull path.

A second portion of the rod 21 includes a recess or groove 30 between a first surface 27 and a second surface 29. The first surface 27 has a first contact point or area 31 and the second surface 29 includes a second contact point or area 33. When the trigger is in the initial position, the second contact point 33 of the second surface 29 engages a first side of the contact 7' and when the trigger 3' is in the pressure-point position, the first contact point 31 of the first surface 27 engages a second side opposite the first side of the contact 7'. When the trigger 3' is in the discharge position, the first surface 27 causes the second side of the contact 7' to deflect or resiliently deform the second end of the contact 7'. The second portion of the rod 21 is biased toward the contact 7' via a cross member or bar 37. The cross member 37 prevents the second portion of the rod 21 from disengaging or decoupling from the contact 7'. In other examples, the distance between the first contact point 31 and the second contact point 33 may vary to adjust the trigger length or pull.

The contact 7' includes at least one sensor or sensing element 9' such as, for example, a strain gauge. The sensor 9' is disposed between the first and second contact points 31 and 33 and/or is disposed within the recess 30. A first end of the contact 7' opposite the rod 21 is fixedly mounted to a frame portion 19 of the firearm (not shown) and a second end of the contact 7' opposite the first end is unrestrained such that it can deflect when a force is applied to the second end.

In operation, at the initial position shown in FIG. 2, the contact point 33 of the second surface 29 is adjacent or engages the contact 7'. The trigger spring 25 biases the trigger 3' toward the initial position. When the trigger 3' is pulled toward the pressure-point position as shown in FIG. 3, the trigger arm 5' pivots about pin 23 against the force exerted by the trigger spring 25. Thus, the trigger spring 25 provides a first resistance as the trigger 3' moves between the initial position and the pressure-point position (to the trigger slack region). Also, the trigger arm 5' cause the rod 21 to move in a direction (e.g., a forward direction) such that the first contact point 31 of the first surface 27 is adjacent or engages the contact 7' and the second contact point 33 of the second surface 29 releases or moves away from the contact 7'.

To discharge the firearm, the trigger 3' is moved through a second trigger path. The second trigger path occurs between the position in which the first contact area 31 of the first surface 27 engages contact 7' as shown in FIG. 3 and the distance required to bend or deflect the contact 7' to a position which causes the firearm to discharge. When the contact 7' (e.g., the send end of the contact 7') is deflected by the rod 21, the sensor 9' generates a signal such as, for example, a voltage or a current that correlates to a distance in which the contact 7' is deflected. When the signal generated by the sensor 9' is greater than a threshold requirement (i.e., when the contact 7' is deflected a predetermined or pre-set distance), the firearm discharges.

After discharge, if the user releases the trigger 3', the trigger assembly 1' moves to the initial position shown in FIG. 2. The trigger spring 25 causes the trigger 3' to rotate in a clockwise direction about axis 35'. As the trigger 3' rotates to the initial position, the rod 21 moves in a rearward direction until the second contact point 33 of the second surface 29 engages the contact 7'. At this position, the signal generated by the sensor 9' is less than the threshold, which may indicate to the circuit (not shown) that the firearm is ready-for-fire.

Additionally or alternatively, for rapid and/or consecutive discharge, the trigger 3' may be moved to the pressure-point position of the trigger slack region as shown in FIG. 3 after a first shot is fired. At the pressure-point position, the first contact point 31 imparts a force to the contact 7' that is less than the force imparted to the contact 7' by the contact point 31 when the trigger 3' is at the discharge position. Such reduction in force reduces or releases the amount of deflection exerted on the contact 7' by the first contact point 31 of the rod 21. In turn, the sensor 9' conveys a signal that corresponds to a smaller deflection or force. A signal that is below a minimum threshold enables the firearm to be ready for a next shot. Thus, the example trigger apparatus 1' enables a user to move the trigger 3' between the pressure-point position and the discharge position (i.e., the second trigger path) to fire rapid and/or consecutive shots after the first shot has been discharged without having to release the trigger 3' to the initial position.

The example trigger assembly 1' may be used with single shot rifles, automatic firearms, semi-automatic firearms, self-loading firearms, or other firearms. When used with self-loading firearms, the readiness to fire occurs when the signal generated by the sensor 9' is below a lower threshold limit or above an upper threshold limit. Additionally or alternatively, after a first shot has been discharged, the firearm can be discharged with slight movement of the trigger 3'. In other words, a user can retain the trigger 3' within the second trigger path such that the first contact point 31 of the first surface 27 slightly moves away from the contact 7'. Thus, a user can optionally hold the trigger 3' at a position such that the trigger slack does not affect the user's aim or alignment. For example, when using a rapid fire firearm (e.g., an Olympic rapid fire firearm), the user can adjust or manipulate the trigger 3' to provide a short trigger pull. In contrast, mechanically operated triggers must be released or moved back a pre-determined distance so that the sear arm is re-engaged to provide a ready-to-fire condition.

The example trigger apparatus 1 and 1' described herein may be used with mechanical or electrical ammunition ignition. When implemented with a mechanical ammunition ignition, the trigger 3' acts on a control element that releases a striking mechanism (e.g., a firing pin) and/or a releases a safety (e.g., a firing pin safety). When implemented with an electrical ammunition ignition, the ammunition is ignited directly via, for example, current impulses (and without the use of a striking mechanism).

The firing of a shot occurs more rapidly after the triggering a firearm implemented with the trigger apparatus 1 or 1' than with a conventional, mechanical weapon because with mechanical weapons, a released hammer still has to cover its striking path, while with the example electronically trigger apparatus 1 or 1' employ electronics and a sensor 9 or 9' to determine when the shot occurs.

Also, with the electronic ignition, there is no hammer momentum to disturb aiming or other the shooting accuracy because only a relatively light trigger is present. Also, the trigger apparatus 1 or 1' have, accordingly, only a simple "trigger" that triggers the shot so that the shot may be triggered without delay. The release time of the shot in this example is shorter than in the case of a conventional pistol wherein after the trigger is actuated, the movement of the hammer or firing pin requires an amount of time that is longer than the time required for heating resistance in the electrical cartridge to a point the cartridge discharges.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A two-stage trigger apparatus for use with firearms, comprising:

a trigger assembly having a trigger and a trigger arm that is movable between a first position and a second position, wherein the trigger arm includes a rod having a first contact point spaced from a second contact point;

a first biasing element to bias the trigger in the first position and provide a first resistance between the first position and the second position; and a switch element assembly disposed substantially between the first and second contact points of the rod, the switch element assembly having a spring element and a sensor operatively coupled to the spring element, wherein the spring element provides a second resistance to the trigger as the trigger moves between a pressure-point position and the second position, and wherein the sensor is to detect a force or deflection imparted on the spring element by the trigger arm when the trigger is in the second position.

2. A trigger apparatus as described in claim 1, wherein the first position is an initial position of the trigger, the second position is a discharge position of the trigger, and the pressure-point position is a trigger slack region of the trigger.

3. A trigger apparatus as described in claim 1, wherein the first biasing element is adjustable to provide an increased or decreased first resistance to the trigger as the trigger moves between the first and second positions.

4. A trigger apparatus as described in claim 1, wherein the trigger and the trigger arm rotate about a lateral pivot axis substantially through a center of gravity of the trigger apparatus such that the trigger apparatus is in a balanced state as the trigger is rotated between the first and second positions.

5. A trigger apparatus as described in claim 4, wherein the first biasing element comprises a torsion spring that is coaxial to the lateral pivot axis.

6. A trigger apparatus as described in claim 5, wherein at least one end of the torsion spring is supported by a frame or stock of the firearm, wherein the at least one end of the torsion spring may be rotated in a clockwise or counterclockwise direction to increase or decrease the first resistance exerted by the torsion spring on the trigger.

7. A trigger apparatus as described in claim 1, wherein the spring element is activated by the rod of the trigger arm as the trigger moves to the second position.

8. A trigger apparatus as described in claim 1, wherein the spring element is interchangeable with a second spring element.

9. A trigger apparatus as described in claim 8, wherein the spring element comprises a leaf spring.

10. A trigger apparatus as described in claim 1, wherein the first contact point engages the switch element when the trigger is in the first position and the second contact point engages the switch element when the trigger is in the second position.

11. A trigger apparatus as described in claim 1, wherein at the first position, the first contact point acts on the spring element to indicate that the trigger is not in the discharge position and at the second position, the second contact point acts on the spring element to indicate that the trigger is in the discharge position.

12. A trigger apparatus as described in claim 1, wherein the second contact point engages or deflects the spring element of the switch element assembly during a trigger slack region of the trigger pull.

13. A trigger apparatus as described in claim 1, wherein the sensor comprises a strain gauge operatively coupled to the spring element.

14. A trigger apparatus as described in claim 13, wherein the strain gauge includes a potentiometer to adjust a trigger slack resistance or the second resistance.

15. A trigger apparatus for use with a firearm, comprising:

a trigger lever and a trigger arm pivotally coupled about a lateral axis of the firearm, the trigger arm having a rod that includes a first contact portion spaced from a second contact portion, wherein the trigger lever pivots between an initial position and a discharge position;

a first spring to bias the trigger lever to the initial position and to provide a first trigger pull resistance between the initial position and a trigger slack region, wherein the trigger slack region has a second resistance that is greater than the first resistance exerted by the first spring;

a switch having a deflectable first end, the switch positioned substantially between the first and second contact portions of the rod such that the first contact portion is adjacent the switch when the trigger lever is in the initial position and the second contact portion is adjacent the switch when the trigger lever is in the discharge position; and a sensor operatively coupled to the switch to detect a force or deflection imparted to the first end of the switch by the second contact portion of the rod when the trigger lever moves through the trigger slack region to the discharge position, the sensor is to convey a signal to cause the firearm to discharge when the trigger lever is at the discharge position.

16. A trigger apparatus as described in claim 15, wherein the switch deflects between a first position and a second position as the trigger lever moves through the trigger slack region to discharge the firearm.

17. A electronic trigger apparatus comprising:

a trigger assembly pivotally coupled to a firearm to pivot between an initial position and a discharge position, the trigger assembly having a rod that includes a first contact portion and a second contact portion, wherein the trigger assembly is configured to provide a greater resistance between a pressure-point position and the discharge position than a resistance provided between the initial position and the pressure-point position;

a switch operatively coupled to the firearm and substantially positioned between the first and second contact portions of the rod, the switch to be engaged by the second contact portion of the trigger assembly when the trigger assembly is in the pressure-point position, and wherein the second contact portion of the trigger assembly is to exert a force or deflect the switch when the trigger assembly is in the discharge position; and a sensor operatively coupled to the switch to sense the force or deflection imparted to the switch by the second contact portion of the trigger assembly when trigger assembly moves between the pressure-point position and the discharge position, wherein the sensor is to convey a signal when the sensor detects a force or deflection imparted on the switch.

18. A trigger apparatus as described in claim 17, wherein a first biasing element provides a first resistance between the initial position and the pressure-point position and wherein the switch provides a second resistance different than the first resistance between the pressure-point position and the discharge position.

19. A trigger apparatus as described in claim 17, wherein the electronic switch comprises a leaf spring, wherein a first end of the leaf spring deflects relative to a second end of the leaf spring.

20. A trigger apparatus as described in claim 17, wherein the sensor comprises a strain gauge coupled to the switch.

* * * * *